US005255652A

United States Patent [19]

Boehm et al.

[11] Patent Number: 5,255,652

[45] Date of Patent: Oct. 26, 1993

[54] SPEED GOVERNOR FOR FUEL INJECTION PUMPS

[75] Inventors: Martin Boehm, Stuttgart; Karsten Hummel, Beilstein-Schmidhausen; Siegfried Ruthhardt, Stuttgart, all of Fed. Rep. of Germany

[73] Assignee: Robert Bosch GmbH, Stuttgart, Fed. Rep. of Germany

[21] Appl. No.: 28,878

[22] Filed: Mar. 10, 1993

[30] Foreign Application Priority Data

Mar. 27, 1992 [DE] Fed. Rep. of Germany ..... 4209956

[51] Int. Cl.[5] ..... F02D 31/00

[52] U.S. Cl. ..... 123/366; 123/373

[58] Field of Search ..... 123/366, 365, 373, 368, 123/374, 179.17

[56] References Cited

U.S. PATENT DOCUMENTS

| | | | |
|---|---|---|---|
| Re. 25,012 | 7/1961 | Dressler | 123/366 |
| 3,015,326 | 1/1962 | Wirsching | 123/365 |
| 3,107,483 | 10/1963 | Hamilton | 123/365 |
| 3,699,941 | 10/1972 | Hughes | 123/366 |
| 3,727,598 | 4/1973 | Knapp | 123/365 |
| 4,204,510 | 5/1980 | Ritter | 123/366 |
| 4,223,653 | 9/1980 | Jaenke | 123/366 |
| 4,252,089 | 2/1981 | Kramer | 123/365 |
| 4,729,357 | 2/1988 | Freudenschoss | 123/365 |
| 4,782,804 | 11/1988 | Lehmann | 123/366 |
| 5,080,063 | 1/1992 | Augustin | 123/366 |

FOREIGN PATENT DOCUMENTS

| | | | |
|---|---|---|---|
| 2003927 | 8/1971 | Fed. Rep. of Germany | 123/366 |
| 740674 | 11/1955 | United Kingdom | 123/366 |
| 2023303 | 12/1979 | United Kingdom | 123/366 |
| 2200767 | 11/1990 | United Kingdom . | |

*Primary Examiner*—Carl S. Miller

*Attorney, Agent, or Firm*—Edwin E. Greigg; Ronald E. Greigg

[57] ABSTRACT

A speed governor for fuel injection pumps of internal combustion engines that has a centrifugal adjuster that acts counter to the force of governor springs to generate a speed-dependent adjustment travel of a governor sleeve and that acts on a fuel quantity adjusting device of a fuel injection pump via the governor sleeve and a governor lever disposed thereupon In this process a charge-pressure-dependently adjustable stop for a full-load fuel supply quantity, which is disposed on a stop lever is pivoted as a function of temperature and speed into the adjustment path of a counter stop disposed on the fuel quantity adjusting device, in such a way that, after a certain speed and a certain operating temperature of the engine has been reached, the stop comes into contact with this counter stop of the fuel quantity adjusting device. For this purpose the stop lever has two lever arms, and a temperature-dependently controlled governor member which acts on the first lever arm, and a speed-dependently-controlled control lever which acts in the same direction of rotation on the second lever arm.

20 Claims, 3 Drawing Sheets

37
35
99
53
95
93
91
97
97
55
81
83
49
3
33

89

35
45
81
83
51
47
33

35
36
87
83
85
46
81
33

SPEED GOVERNOR FOR FUEL INJECTION PUMPS

BACKGROUND OF THE INVENTION

The invention is based on a speed governor for fuel injection pumps in internal combustion engines as defined hereinafter. With a speed governor known from DE-OS 37 03 628 (UK 22 00 767), a centrifugal adjuster, counter to the force of a governor spring, converts an adjusting force that corresponds to the speed of the internal combustion engine to be supplied into an adjusting motion of a governor sleeve that connects the centrifugal adjuster to a governor rod of a fuel injection pump via a governor lever. During this, the governor lever is connected with the governor rod via a strap that has a stop that cooperates, as a counter stop, with a stop that limits the amount of full-load fuel and is disposed on an adjustable, one-armed stop lever. This stop lever is connected rotatably at its end remote from the stop with an axially adjustable bolt and has on its lever arm an oblong slot, into which a two-armed control lever reaches with the end of its one lever arm. The second lever arm of the control lever fixedly attached to the housing is adjustable between two end positions by means of the governor sleeve, so that the control lever and thus the stop lever is pivotable in and out of its working position, depending on the speed of the internal combustion engine to be supplied.

In the known speed governor, when the full-load stop becomes active it is, however, only controlled in dependence on speed, so that the influences of temperature and charge pressure cannot be taken into consideration, which can lead to increased pollutant emissions due to excessive quantities of injected fuel. This is particularly apparent on restarting a warmed-up internal combustion engine that is supplied with the increased quantity of fuel necessary for cold starting, which can no longer be burned without producing soot.

OBJECT AND SUMMARY OF THE INVENTION

In contrast, the speed governor in accordance with the invention has an advantage that the fullload stop of the fuel quantity adjusting device of the fuel injection pump is adjustable depending on speed, charge pressure and temperature. For this reason, a stop lever has two arms and is acted upon by a temperature-dependent actuator and a speeddependent actuator, as defined hereinafter. The temperature-dependent actuator acts on the two-armed stop lever in the same direction of rotation as the speed-dependent actuator, and the stop lever can pivot into its working position in an overlap area with the stop of the fuel quantity adjusting device by means of both actuators, or out again, while the actuator connected with the stop lever as defined hereinafter can advantageously change the position of the stop lever and thus of the full-load stop continually in the adjusting direction of the quantity adjusting device, depending on the charge pressure. In doing this the temperature-dependent governor intervention is advantageously effected only in the case of starting the warmed-up engine, so that an excessive fuel supply quantity is avoided. While the engine is running, the stop lever as defined hereinafter is pivoted by the speed-dependent actuator so far into the range of adjustment of the counter stop on the fuel quantity adjusting device that the temperature-dependent actuator no longer comes in contact with the stop lever. This eliminates hindrance by the temperature-dependent actuator during the continual adjusting stroke of the stop lever by the actuator that is dependent on charge pressure.

Furthermore, the use of a two-armed lever for temperature-dependent pressing of the stop lever into the working position enables small adjustment travels with small forces, which in turn permits the use of compact actuators with a smaller working capacity, such as memory or bimetallic springs, and this decrease in space required serves to reduce the dimension of the entire speed governor or offers the option to install other governor members.

A further advantage is achieved as defined hereinafter in that the stop lever is held in contact with the speed-dependent actuator by mean of a spring element, so that complete functioning capability of the adjustable full-load stop is retained, even in a position of the speed governor other than vertical. To be able to compensate for relatively high assembly and production tolerances, the counter stop on the fuel quantity adjusting device and cooperating with the stop lever is advantageously embodied as an adjusting screw that permits adjustment, as defined hereinafter.

The invention will be better understood and further objects and advantages thereof will become more apparent from the ensuing detailed description of preferred embodiments taken in conjunction with the drawings.

DESCRIPTION OF THE PREFERRED EMBODIMENT

Figure 1:
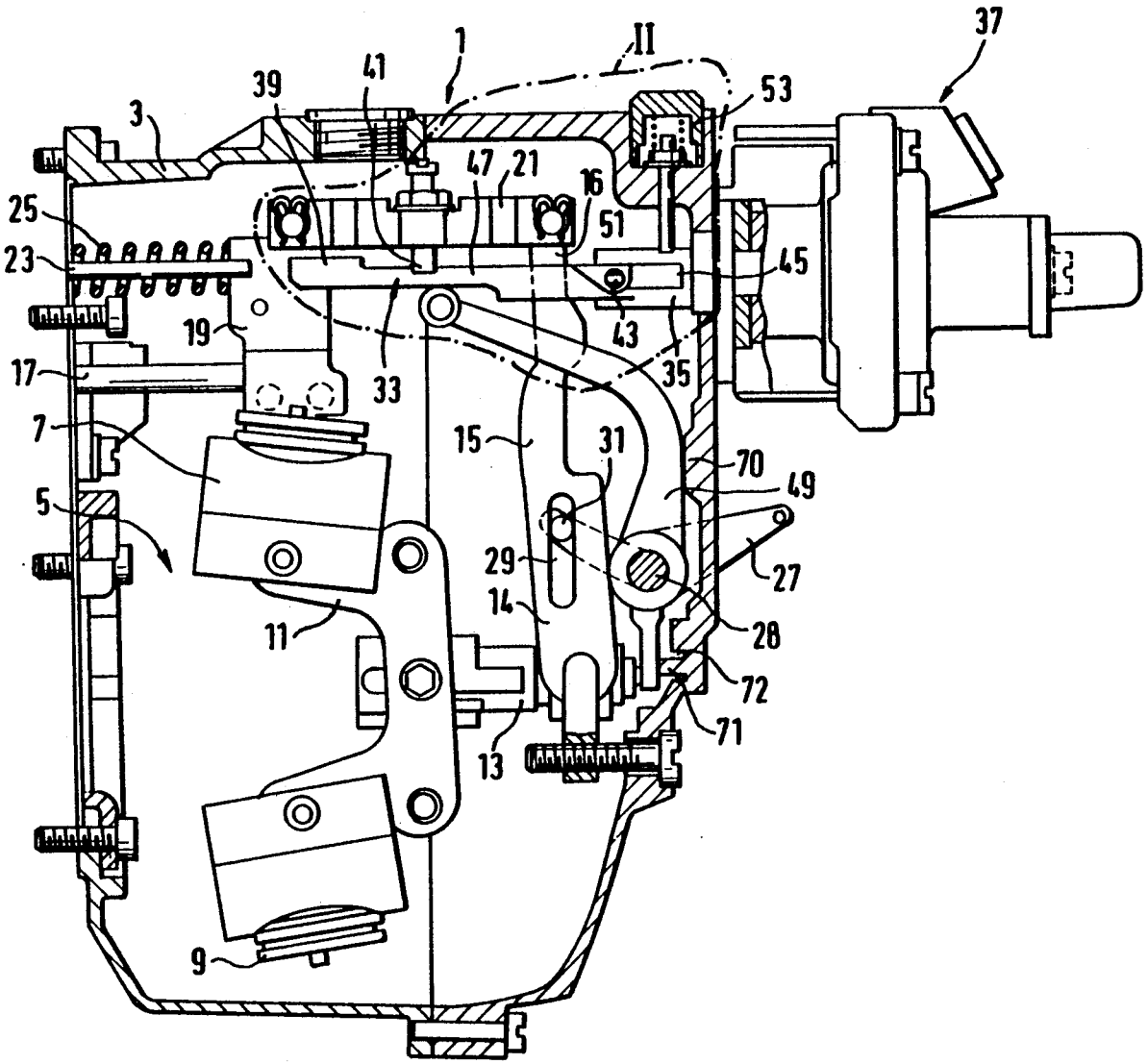
FIG. 1 shows a section through the speed governor in accordance with the invention.

The description of the speed governor represented in FIG. 1 is limited to the components that serve to explain the invention.

The speed governor 1 shown in FIG. 1 is mounted on a fuel injection pump (not shown) whose camshaft protrudes into the housing 3 of the speed governor 1 and is connected there to a centrifugal adjuster 5, which is driven by this governor with a speed proportional to that of the internal combustion engine. The centrifugal adjuster 5 has two flyweights 7, which actuate a governor sleeve 13 via two bell cranks 11 counter to the forces of governor springs 9, under the influence of the centrifugal forces that arise during rotation. The governor sleeve 13 is rotatably connected to one lever end 14 of a two-armed governor lever 15, which is connected at its other lever end 16 to a fuel quantity adjusting device. The fuel quantity adjusting device comprises the governor rod 17, which is connected via an intermediate lever 19 to a strap 21 that is pivotably attached to the upper lever end 16 of the governor lever 15. The strap 21 is pivotably connected to the intermediate lever 19, which, in addition, has a restoring spring 25 supported on the housing 3 and guided by a bolt 23. The governor lever 15 is pivotable not only by means of the governor sleeve 13, but also with the aid of a two-armed, adjusting lever 27 supported on a pin 28 which is fixedly attached to the housing, via a peg 31 that is guided in an oblong hole 29 in the governor lever 15 and that, at the same time, forms the shaft of the two-armed governor lever 15.

Figure 2:
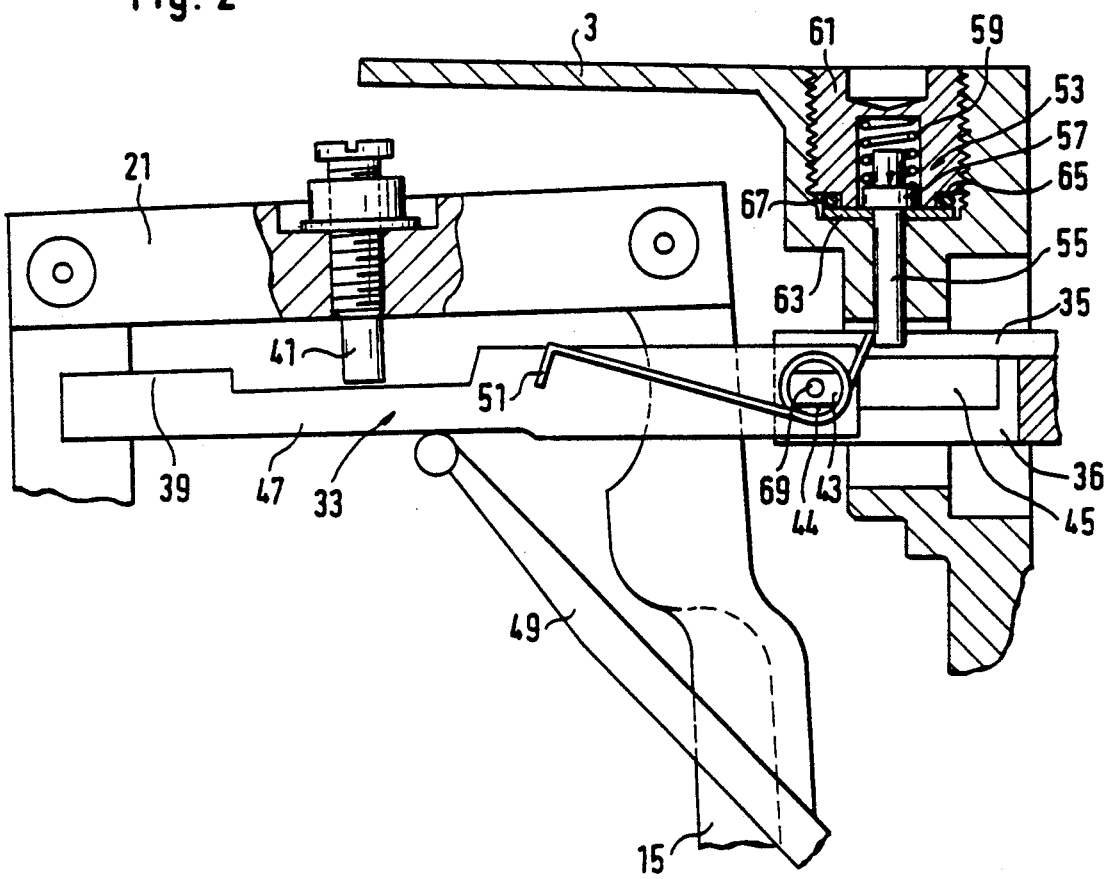
FIG. 2 shows an enlarged detail from FIG. 1 in which the connection of the stop lever with the lifting rod of the charge-pressure-dependent actuator via a two-sided bolt is represented.

To limit the governor rod travel in the direction of a higher fuel supply quantity, as shown in FIG. 2, a stop lever 33 is disposed in the speed governor 1, and is pivotably connected to a lifting rod 35 of a charge-pressure-dependently controlled actuator 37 of a known design attached to the housing 3, that rod having a longitudinal slot 36, FIG. 2; the stop lever 33 has on its end a stop 39 in the form of an angular profile that cooperates with a counter stop 41 in the form of an adjusting screw disposed on the strap 21.

In the first exemplary embodiment, the stop lever 33 comprises two lever arms that are connected, fixed against relative rotation and in a positionally stabilized manner, to one another by means of a bolt 43, which forms a pivot point 69 and has two flattened sides 44 located opposite one another; this bolt 43, with its ends protruding from the lever arms of the stop lever 33, is guided, over its remaining, circular circumferential surface, in a bore 46 disposed in the wall of the lifting rod 35 that forms a fork, and perpendicular to the plane of the longitudinal slit 36, thus creating the rotatable connection to the lifting rod 35 of the charge-pressure-dependent actuator 37.

Figure 3:
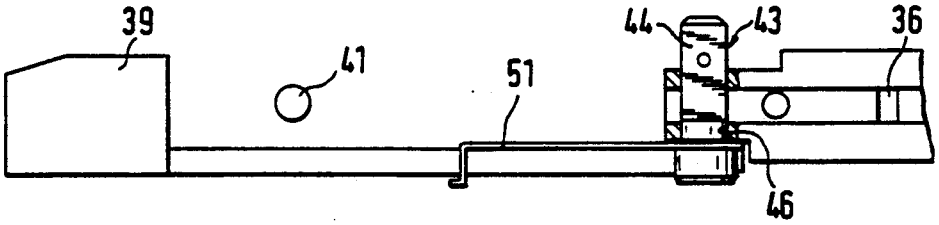
FIG. 3 shows the stop lever and its attachment to the charge-pressure-dependent actuator corresponding to FIG. 2 in an enlarged, overhead view.

The one lever arm 45 of the stop lever 33 that faces the charge-pressure-dependently controlled actuator 37 is, as shown in FIG. 3, guided inside the longitudinal slot 36 of the lifting rod 35, which is fork-shaped at this position.

The second lever arm 47 of the stop lever 33, the arm remote from the lifting rod 35, is acted upon by the end of one arm of a two-armed control lever 49 that is likewise rotatably supported about the pin 28 shown in FIG. 1, fixedly attached to the housing, and in the pivoting path, the other lever end, remote from the stop lever 33, a stop 70 that is fixedly attached to the housing is disposed; the other lever arm, which is remote from the stop lever 33, can be brought to another, adjustable stop 71 fixedly attached to the housing and having a spring 72 that brings the lever arm into contact with the governor sleeve 13. The control lever 49 is thus pivoted as a function of speed, and the stop lever 33, by means of a spring element 51 in the form of a torsion spring supported on the other side on the lifting rod 35, is kept in contact with the control lever 49, which in turn can be brought into contact with its one stop 70 by the spring 72, when the governor sleeve 13, as the rpm rises, has lifted away from the control lever 49. On the side of the stop lever 33 opposite the control lever 49, a temperature-dependent governor member 53 engages the lever arm 45 guided in the lifting rod 35; both this member and the control lever 49 act on the stop lever 33 in the same direction of rotation and pivot it into the adjustment path of the counter stop 41 on the strap 21, so that the stop lever, as it overlaps with the counter stop, becomes effective as a stop.

As shown in FIG. 2, the temperature-dependent governor member 53 comprises a collar bolt 55, which extends through the longitudinal slot 36, acts in the lifting rod 35 on the lever arm 45 of the stop lever 33, is guided with play in the housing 3, and has a collar 57 on which a spring 59, which is supported on its other end on a cup-shaped screw plug 61 that plugs the opening in the housing 3, comes into contact on the end remote from the lifting rod 35. This spring 59 acting as an actuator is controlled as a function of temperature and expands when heat is supplied, can be a bimetallic spring or a spring with "shape memory effect," and can be subjected to the temperature of the coolant of the cooling loop of the engine.

To precisely adjust the position of the collar bolt 55, which is movable between two stops, and thus to adjust the governor travel of the temperature-dependently controlled governor member 53, adjusting disks 63 that act at the same time as one of the stops of the collar bolt 55, whose collar comes in contact with them, are disposed between the housing 3 and the face end of the cup-shaped screw plug 61. A sealing ring 67 guided in a step 65 on the circumference of the screw plug 61 assures the secure sealing of the speed governor 1 toward the outside.

The position of the collar bolt 55 is adjusted such that, at maximum expansion of the temperaturedependent spring 59, or contact with its stop, the bolt can act on the lever arm 45 of the stop lever 33 only until a medium or high speed is attained and the control lever 49 pivots the stop lever 33 further into the working area with the counter stop and therefore out of the range of adjustment of the temperature-dependent governor member 53.

Figures 4, 5, 6, 7:
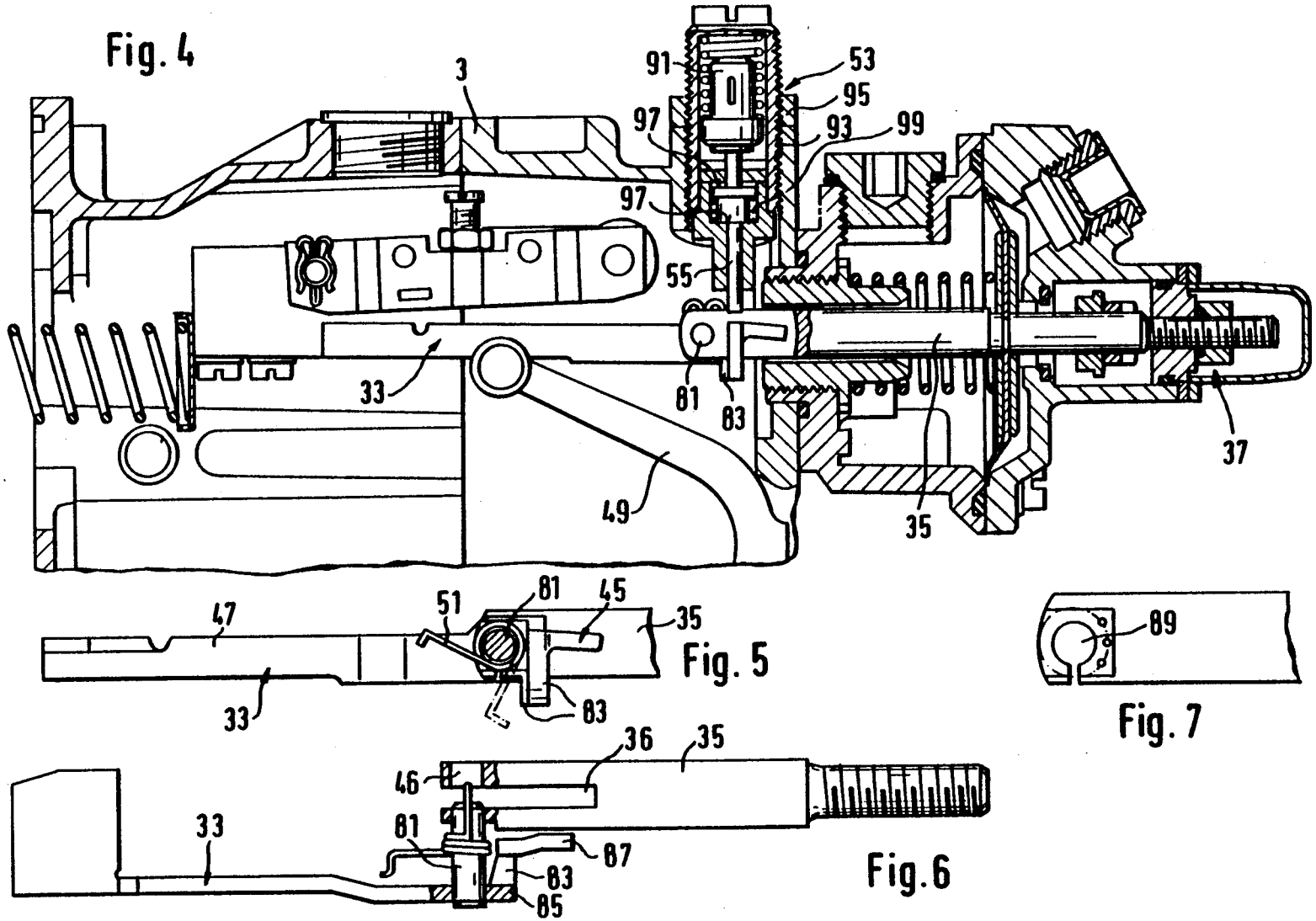
FIG. 4 shows a second variation of the embodiment analogous to the representation of FIG. 2, in which the lifting rod of the charge-pressuredependent actuator is connected to the stop lever via a bayonet catch.
FIG. 5 is an enlarged representation of this connection.
FIG. 6 is an overhead view of the lifting rodstop lever connection of FIG. 5 in an installed position; an FIG. 7 shows the end of the lifting rod with the insertion bores for the spring element.

The second exemplary embodiment, shown in FIG. 4, is distinguished from the one shown in FIG. 2 solely by the type of connection of the stop lever 33 with the lifting rod 35 of the charge-pressure-dependent actuator 37 and the design of the temperature-dependent governor member 53.

The two-armed stop lever 33, shown enlarged in FIG. 5, is connected here with the lifting rod 35 via a bayonet catch. Adjacent to the lifting rod 35, the lever arm 45, which is rotatably supported about a bolt 81 and rigidly connected to the two-armed lever arm 47, is divided into two parts by means of a U-profile intermediate part 83; the first part 85 is the direct extension of the lever arm 47 adjacent to the bolt 81, while the second part 87 is maintained in an offset, parallel position to the first part 85 by the U-shaped intermediate part 83 mounted at a right angle to the first part 85 with its closed side protruding downward. For assembly, which is explained by FIG. 6, the bolt 81 of the stop lever 33, onto which the spring element 51 has already been slipped, is introduced into the bore 46 of the lifting rod 35. In the process, the stop lever 35 is tilted vertically upward so that it can be slipped onto the lifting rod 35 far enough that its second part 87 is at the height of the longitudinal slot 36. In this position the stop lever 33 is tilted backward in an approximately parallel position to the lifting rod 35, so that the stop lever 33 is guided via its second part 87 in the longitudinal slot 36 of the lifting rod 35, and is secured against slipping out. Analogously to FIGS. 1 and 2, the stop lever 33 is tightened against the lifting rod 35, thus forming a secure contact with the temperature-dependent governor member 53 or the control lever 49 via the spring element 51, whose prestressing force can be adjusted via a change in position shown in FIG. 7 of the knuckle bore 89. In this case three bores 89, for example, that are located on the same radius and are offset from each other by 35 are provided in the lifting rod 35

The temperature-dependent governor member 53 shown in FIG. 4 is distinguished from the one in FIG. 2 solely in that, instead of the temperature-dependent spring 59, an expandable material governor 91 is used. The advantage of doing this is that this governor is infinitely adjustable in the form of a complete component unit, via its insertion depth, via a thread 93 disposed on its circumference and a check nut 95. The expandable material governor 91 moves the collar bolt 55 between two stops 97 counter to an additional restoring spring 99.

The position shown in FIG. 1 of the centrifugal adjuster 5 and the control lever 49 corresponds to a high speed.

The speed governor in accordance with the invention operates in the following manner. During the starting process and during run-up of the cold engine, the stop lever 33, which is maintained in contact with the control lever 49 by means of the spring element 51, pivots out of the range of adjustment of the counter stop 41 on the strap 21 because the governor sleeve 13 connected to the control lever 49 is in its initial position. The full-load stop is designated inside the pump for this point in operation, so that the starting quantity is adjustable independently of the position of the stop lever 33. After the engine has been run up, the governor sleeve 13 is displaced by the outward motion of the flyweights of the centrifugal adjuster 5 and, as a consequence of this, the control lever 49 pivots the stop lever 3 which is connected to it, into the adjustment path of the counter stop 41 on the strap 21, and the stop 39 takes over the task of limiting the full load.

The temperature-dependent governor member 53 likewise adjusts itself when the working temperature of the internal combustion engine is reached, and holds the stop lever 33 in its position that defines the adjustment travel of the strap 21 counter to the restoring force of the spring element 51 at very low speeds or when the engine is not running. At medium and high speeds the control lever 49 comes into contact with the stop lever 33 and pivots it further into the overlap area in the direction of adjustment of the counter stop, so that it is lifted from the collar bolt 55 and the movement of the stop lever 33, which is displaceable by the charge-pressure-dependent actuator 37, is not hindered by friction resulting from contact with the collar bolt 55.

When the engine is shut off and the control lever 49 correspondingly pivots back, the collar bolt 55 of the temperature-dependent governor member 53 holds the control lever in the adjustment path of the counter stop 41 on the strap 21 until the temperature of the engine has dropped below the operating temperature and the spring element 51 displaces the spring 59 of the temperature-dependent governor member 53 back into its initial position. When the warm engine is restarted, i.e., before the spring 59 has been restored, the charge-pressure-dependent full-load stop thus becomes effective immediately, which prevents the injection of the excessive quantity of fuel corresponding to the col start.

In the range of medium and high speeds, the speed governor in accordance with the invention operates in the known way, i.e., as speed increases, the governor rod 17 is displaced by means of the outward motion of the flyweights 7 of the centrifugal adjuster 5 via the governor sleeve 13 and the governor lever 15 in the direction of a lower fuel supply quantity, until the speed drops and the inward motion of the flyweights 7 effects a new adjustment of the expandable material governor in the direction of a higher fuel supply quantity, and a state of equilibrium comes about by means of the force of the governor springs 9. The adjustment lever 27, which acts on the governor lever 15, serves to change the position of the governor rod 17 arbitrarily.

To limit the full-load fuel supply quantity, the stop lever 33 that receives the stop 39 is pivoted into the adjustment path of the counter stop 41 disposed on the strap 21. In addition, the stop lever 33 is displaced by the pressure-charge-dependent actuator 37 in the direction of a higher fuel supply quantity as speed and thus charge pressure increase.

Because of the design of the speed governor 1 in accordance with the invention, the temperaturedependent intervention for adjustment of the fullload stop only takes place during warm starting of the internal combustion engine and at low speed, while in the remainder of the operation range, the adjustment of the full-load stop is executed as a function of both speed and charge pressure.

The foregoing relates to preferred exemplary embodiments of the invention it being understood that other variants and embodiments thereof are possible within the spirit and scope of the invention, the latter being defined by the appended claims.

What is claimed and desired to be secured by Letters Patent of the United States is:

1. A speed governor for fuel injection pumps of internal combustion engines, having a governor sleeve (13) that is adjustable counter to a restoring force of a speed-dependent force of a speed governor (1) of the fuel injection pump, by means of which sleeve a governor lever (15) connected to a fuel quantity adjusting device is actuatable; a stop (39) is disposed on a stop lever (33) for limiting the quantity of injected fuel, the stop is adjustable about a bolt (43) in a direction of motion of the fuel quantity adjusting device, with which a counter stop (41) coupled to the governor lever (15) can be brought into contact in the direction of motion of the fuel quantity adjusting device; a control lever (49) engages the stop lever (33) and is pivotable counter to a pullback force by means of the governor sleeve (13) about a stationary axis (28) between two stops (70, 71), and a displacement position occupied by the governor sleeve (13) pivots the stop (39) out of its working position in an overlap area of the counter stop (41) when the engine is not running or below an idling speed of the engine, the stop lever (33) including first and second lever arms (47, 45) that are pivotable about a pivot (69), and that, in the same direction of rotation, the control lever (49) engages said first lever arm (47), and a temperature-dependently controlled governor member (53) engages said second lever arm (45).

2. The speed governor as defined in claim 1, in which for changing the full-load fuel supply quantity the stop lever (33) that receives the adjustable stop (39) is adjustable as a function of the charge pressure of the engine in the direction of motion of the counter stop.

3. The speed governor as defined by claim 1, in which the first and second lever arms (47, 45) of the stop lever (33) are connected, fixed against relative rotation and in a positionally stabilized manner via a bolt (43), having two flattened sides located opposite on another.

4. The speed governor as defined by claim 1, in which the stop lever (33) is rotatably guided via the bolt (43) in a bore (46) disposed at a right angle to a longitudinal slot (36) in the wall of the lifting rod (35), and is thus connected to a charge-pressure-dependent actuator (37).

5. The speed governor as defined by claim 4, in which the stop lever (33) is maintained in contact with the control lever (49) via a spring element (51).

6. The speed governor as defined by claim 1, in which the stop lever (33) is rotatable around the pivot (69) fixed on the lifting rod and is connected to the lifting rod (35) integrally and via a bayonet-like catch formed by the interposition of a U-shaped intermediate part (83) on the lever arm (45).

7. The speed governor as defined by claim 1, in which the temperature-dependent governor member (53) that acts on the second lever arm (45) of the stop lever (33) has a bolt (55) that is adjustable between two stops by means of a temperature-dependent actuator (53).

8. The speed governor as defined by claim 7, in which the temperature dependent actuator is a compression spring with a memory effect.

9. The speed governor as defined by claim 7, in which the temperature dependent actuator is an expandable material.

10. The speed governor as defined by claim 7, in which one of the stops of the bolt (55) is a screw plug (61) that can be screwed from the outside into the housing of the fuel injection pump and whose insertion depth is adjustable by means of adjusting disks (63).

11. The speed governor as defined by claim 1, in which the stop (41) is embodied as an adjusting screw that is screwed, transversely to the direction of adjustment of the fuel quantity adjusting device, into a strap (21) that couples the fuel quantity adjusting device to the governor lever (15).

12. The speed governor as defined by claim 1, in which the adjustment travel of the stop lever (33), which can be executed by means of the temperature-dependent governor member (53), is shorter than the adjustment travel that can be executed by means of the control lever (49).

13. The speed governor as defined by claim 2, in which the adjustment travel of the stop lever (33), which can be executed by means of the temperature-dependent governor member (53), is shorter than the adjustment travel that can be executed by means of the control lever (49).

14. The speed governor as defined by claim 3, in which the adjustment travel of the stop lever (33), which can be executed by means of the temperature-dependent governor member (53), is shorter than the adjustment travel that can be executed by means of the control lever (49).

15. The speed governor as defined by claim 4, in which the adjustment travel of the stop lever (33), which can be executed by means of the temperature-dependent governor member (53), is shorter than the adjustment travel that can be executed by means of the control lever (49).

16. The speed governor as defined by claim 5, in which the adjustment travel of the stop lever (33), which can be executed by means of the temperature-dependent governor member (53), is shorter than the adjustment travel that can be executed by means of the control lever (49).

17. The speed governor as defined by claim 6, in which the adjustment travel of the stop lever (33), which can be executed by means of the temperature-dependent governor member (53), is shorter than the adjustment travel that can be executed by means of the control lever (49).

18. The speed governor as defined by claim 7, in which the adjustment travel of the stop lever (33), which can be executed by means of the temperaturedependent governor member (53), is shorter than the adjustment travel that can be executed by means of the control lever (49).

19. The speed governor as defined by claim 10, in which the screw plug (61) surrounds the bolt (55) and the actuator in a cuplike manner, and the adjusting disks (63) simultaneously form a variable stop for a collar on the bolt (55).

20. The speed governor as defined by claim 9, in which the expandable material (91) of the temperature-dependent actuator moves the collar bolt (55) via the insertion depth of the entire temperature-dependent governor member (53) into the housing (3) via a thread (93) between two faces (97) that are adjustable.

* * * * *